US010787350B2

(12) United States Patent
De Jong

(10) Patent No.: US 10,787,350 B2
(45) Date of Patent: Sep. 29, 2020

(54) LIFTING COLUMN WITH MODULAR POWER SYSTEM FOR LIFTING A VEHICLE AND SYSTEM AND METHOD THEREFOR

(71) Applicant: Stertil B.V., Kootstertille (NL)

(72) Inventor: Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 1175 days.

(21) Appl. No.: 14/324,903

(22) Filed: Jul. 7, 2014

(65) Prior Publication Data

US 2016/0002014 A1 Jan. 7, 2016

(51) Int. Cl.

| | |
|---|---|
| ***B66F 3/46*** | (2006.01) |
| ***B66F 3/24*** | (2006.01) |
| ***B66F 3/44*** | (2006.01) |
| ***B66F 7/16*** | (2006.01) |
| ***B66F 7/28*** | (2006.01) |
| ***B66F 7/04*** | (2006.01) |

(52) U.S. Cl.

CPC ..... *B66F 3/46* (2013.01); *B66F 3/24* (2013.01); *B66F 3/44* (2013.01); *B66F 7/04* (2013.01); *B66F 7/16* (2013.01); *B66F 7/28* (2013.01)

(58) Field of Classification Search

CPC ..... B66F 3/00; B66F 3/24; B66F 3/44; B66F 3/46; B66F 7/04; B66F 7/16; B66F 7/28

USPC ..... 254/89 R

See application file for complete search history.

(56) References Cited

U.S. PATENT DOCUMENTS

| | | | | |
|---|---|---|---|---|
| 5,349,535 | A * | 9/1994 | Gupta | B60L 11/1818 320/106 |
| 5,911,408 | A * | 6/1999 | Berends | B66F 7/04 254/2 B |
| 5,975,495 | A * | 11/1999 | Berends | B66F 7/04 254/2 B |
| 6,315,079 | B1 * | 11/2001 | Berends | B66F 3/46 187/203 |
| 6,505,815 | B1 * | 1/2003 | Dellamore | B66F 7/04 254/2 B |
| 6,634,461 | B1 * | 10/2003 | Baker | B66F 7/20 187/210 |
| 6,817,449 | B2 | 11/2004 | Berends | |
| 7,416,039 | B1 * | 8/2008 | Anderson | B60K 1/00 180/165 |
| 7,500,816 | B2 * | 3/2009 | Berends | B66F 3/46 187/210 |
| 8,083,034 | B2 * | 12/2011 | Bordwell | B66F 7/20 187/210 |
| 8,191,865 | B2 | 6/2012 | Polins et al. | |
| 8,246,008 | B2 | 8/2012 | De Jong et al. | |

(Continued)

FOREIGN PATENT DOCUMENTS

WO 2010118893 A1 10/2010

*Primary Examiner* — Orlando E Aviles
*Assistant Examiner* — Seahee Hong
(74) *Attorney, Agent, or Firm* — The Webb Law Firm

(57) ABSTRACT

The present invention relates to a lifting column, lifting system and method for lifting a vehicle. The lifting column according to the invention includes a frame with a carrier configured for carrying the vehicle; a drive for driving the carrier in at least one of the ascent or descent of the carrier; and a modular power system configured for providing power to the drive and adapted to comprise a variable number of energy storage systems.

12 Claims, 4 Drawing Sheets

(56) References Cited

U.S. PATENT DOCUMENTS

| | | | | |
|---|---|---|---|---|
| 8,251,184 | B2 * | 8/2012 | De Jong | B66F 7/16 187/210 |
| 8,496,090 | B2 | 7/2013 | Berends | |
| 8,523,146 | B2 | 9/2013 | Polins et al. | |
| 8,567,761 | B2 * | 10/2013 | De Jong | B66F 3/46 254/134 |
| 8,752,675 | B2 | 6/2014 | Berends | |
| 2004/0022611 | A1 * | 2/2004 | Finkbeiner | B66F 3/46 414/458 |
| 2006/0182563 | A1 * | 8/2006 | De Jong | B66F 3/24 414/427 |
| 2008/0053716 | A1 * | 3/2008 | Scheucher | B60L 8/00 180/2.1 |
| 2009/0205907 | A1 | 8/2009 | Berends | |
| 2010/0001241 | A1 * | 1/2010 | Rentschler | B66F 9/06 254/2 R |
| 2010/0066278 | A1 * | 3/2010 | De Jong | B66F 7/16 318/376 |
| 2010/0207079 | A1 | 8/2010 | Kooima et al. | |
| 2011/0014501 | A1 * | 1/2011 | Scheucher | B60K 1/04 429/7 |
| 2011/0037041 | A1 * | 2/2011 | DeJong | B66F 3/46 254/89 R |
| 2012/0037864 | A1 * | 2/2012 | Finkbeiner | B66F 3/44 254/93 R |
| 2012/0080653 | A1 * | 4/2012 | Gray | B66F 3/24 254/89 R |
| 2013/0240300 | A1 † | 9/2013 | Fagan | |
| 2014/0161568 | A1 | 6/2014 | De Jong | |
| 2014/0161583 | A1 | 6/2014 | Luinge | |

* cited by examiner
† cited by third party 124
120
160
154
152
158
150
156

102
4,22
120
128
192
16
18
6
8
12
4,22
124
4
4,22
128
10
14
Electrical Grid Connector-134
Computing Means-130
Central Controller-122
137-Central battery monitoring system
126-Wireless communication Means
132-Battery
136-Memory/Storage
139-Communication Module
138
Financial Control Network-142
Maintenance Network-144
146-External Network
140-Workshop Control Network

LIFTING COLUMN WITH MODULAR POWER SYSTEM FOR LIFTING A VEHICLE AND SYSTEM AND METHOD THEREFOR

BACKGROUND OF THE INVENTION

1. Field of the Invention

The invention relates to a lifting column for lifting a load, such as a vehicle.

2. Description of Related Art

Lifting columns are known from practice and comprise a frame with a carrier that is connected to a drive for moving the carrier upwards and downwards. In the ascent mode, hydraulic oil is pumped to a cylinder for lifting the carrier. In the descent mode hydraulic oil returns to the reservoir. Such lifting column is disclosed in U.S. Patent Application Publication No. 2006/0182563, which is incorporated herein by reference.

Known lifting columns require a power supply involving a permanent connection to the electrical grid and/or the use of a battery in case of a mobile lifting column. Permanent connection limits the range of operation for the lifting column. Mobile lifting columns with a battery need recharging after a number of lifting operations. This requires an infrastructure for recharging the battery and the charging process may reduce the time period the lifting column is available for lifting operations.

An object of the present invention is to obviate or at least reduce the above stated problems.

SUMMARY OF THE INVENTION

This object is achieved with a lifting column for lifting a vehicle according to the invention, the lifting column comprising:

- a frame with a carrier configured for carrying the vehicle;
- a drive for driving the carrier in at least one of the ascent or descent of the carrier; and
- a modular power system configured for providing power to the drive and adapted to comprise a variable number of energy storage systems.

Providing a modular power system to the lifting column, more specifically a mobile lifting column, enables the lifting column to operate independently. According to the invention the modular power system is adapted to comprise a variable number of energy storage systems. In this application, an energy storage system includes regular batteries and also all other energy storage systems capable of storing energy and providing energy/power to the drive of a lifting column, for example involving super capacitors.

By providing the modular power system with the capability of comprising a variable number of energy storage systems the lifting column can be adapted to its required level of use. More specifically, the type, power and number of energy storage systems can be varied according to the lifting requirements. These lifting requirements may relate to the number of (expected) lifting operations, the type of load, the frequency of lifting movements etcetera.

In a presently preferred embodiment the modular power system comprises a modular rack which is configured for removing, switching and/or adding energy storage systems. This modular rack enables a user to remove an entire energy storage system rack or remove a number of energy storage systems from a mobile lifting column. Also, energy storage systems can be switched. For example, empty energy storage systems can be removed and replaced by a charged energy storage system. This prevents the mobile lifting column from not being available for lifting operations due to empty energy storage systems. Furthermore, in case of intensified use of the mobile lifting column, the number of energy storage systems can be increased by adding one or more energy storage systems to the modular rack. Also, the type of energy storage systems can be changed depending on the intended use for the mobile lifting column.

In a preferred embodiment according to the present invention the lifting column further comprises an energy regeneration system.

By regenerating energy the energy storage systems can be charged while the lifting column is in operation. In a presently preferred embodiment this energy regeneration system enables that in an ascent mode a motor drives a pump and is configured for energy generating, and in a descent mode is configured for energy generation enabling the pump to drive the motor as generator. This increases the number of lifting operations that can be performed with a mobile lifting column without recharging, switching or adding energy storage systems.

Alternatively or in addition to charging the energy storage systems from the electrical grid the lifting column can be provided with additional charging possibilities including induction, solar energy, wind energy, for example. This further improves the sustainability of the mobile lifting column according to the invention.

In a presently preferred embodiment according to the present invention the lifting column further comprises an energy storage management system capable of monitoring energy storage system status of individual energy storage systems.

The energy storage management system provides information about the energy storage system status of a lifting column. This provides the user with information about the number of lifting operations that can be performed with the present energy storage systems. In addition or alternative thereto the energy storage management system provides information about the life cycle of the energy storage system. This life cycle information can be retrieved from the charging cycle as indication of the energy storage system condition. This can also be used to predict the number of lifting operations that can be performed with the lifting column. This enables optimal energy storage system management of one or more lifting columns.

As a further advantage the modular power system enables the use of several or relatively small energy storage systems in stead of one large energy storage system. This adds additional flexibility to the mobile lifting column. Furthermore, this enables placing two or more energy storage systems in series or parallel depending on the actual requirements for the mobile lifting column.

The invention further relates to a lifting system comprising a number of aforementioned lifting columns The lifting system provides the same effects and advantages as those stated with reference to the lifting column.

In a presently preferred embodiment the lifting system comprises a central controller. The central controller enables controlling a group of selected mobile lifting columns Such central controller preferably comprises:

- a transmitter/receiver for communication with individual lifting columns;
- computing means, such as a processor, for determining required control actions for individual lifting columns; and wherein at least one of the central controller or at least one of the lifting columns comprises user input means configured for providing the central controller with input.

Preferably, the central controller is provided with a central energy storage management system capable of monitoring energy storage system status of individual energy storage systems of individual lifting columns In a presently preferred embodiment the central energy storage management system cooperates with the energy storage management systems of individual lifting columns. This provides overall information for the group of selected mobile lifting columns in relation to the number of lifting operations that can be performed with this specific group without requiring recharging of one or more of the energy storage systems involved. Preferably, also lifecycle information of energy storage systems is monitored and can be communicated to the user and/or an external controller or network including a service and maintenance department, for example. The central energy storage management system can be incorporated in a central controller and/or in a network configuration, including an external network of a maintenance department or service company.

The energy storage management system of an individual lifting column may indicate energy storage system status so that this information can be taken into account when selecting such column for a group of mobile lifting columns for a lifting operation. This prevents selecting a mobile lifting column for a group that has insufficient energy for the entire intended/expected lifting operation. This improves the selection procedure of lifting columns for a group and reduces the amount of time required for preparing lifting operations. This enables incorporation of energy system status in the selection process of lifting columns for a new lifting operation. This achieves a further optimization of the selection process such that preferably can be guaranteed that the selected group of lifting columns is capable of performing the lifting operation without requiring charging, switching and/or adding energy storage systems during the lifting operation.

The central controller can determine and communicate required controller actions to the individual lifting columns. The central controller can use computing means, such as a processor, to determine the required and/or desired control actions. This may involve comparing height measurements from different lifting columns and calculating a corrective action, if necessary. The central controller can be positioned such that all communication between an individual lifting column and a central controller has a minimum risk of being disturbed. This contributes to a safe and robust operation with the lifting columns. For example, the central controller can be positioned above a group of lifting columns it is controlling. This may involve attaching the central controller to a ceiling of the workshop, for example. This obviates the need of providing individual lifting columns with separate computing means. The central controller can be used to control a group of selected lifting devices with a selection made in a manner known to the skilled person, for example as described in U.S. Pat. No. 7,500,816, which is incorporated herein by reference. The selective individual lifting columns may involve the use of a key or card.

In a further embodiment according to the invention the central controller may control two or more independent groups of selected lifting columns. This renders the use of a central controller further cost effective. This has as a further advantage that the central controller is provided with information about the status of lifting columns that are outside a specific group of selected lifting columns. This enables the central controller to suggest lifting columns that could be selected for a further group. This further improves the selection procedure and prevents situations with an empty energy storage system of a lifting column that is in use.

Optionally, the system may comprise a signal distributor for receiving and forwarding signals between the central controller and one or more of the individual lifting columns. This may involve a wired signal transceiver and provides further flexibility to the position of the central controller relative to the lifting columns. In addition, the distributor further increases the working area of the central controller.

The invention further also relates to a method for providing power to a lifting column, comprising the step of providing a lifting column and/or lifting system as described in this application, and providing a modular power system with a number of energy storage systems.

The method according to the invention provides the same effects and advantages as those stated with reference to the lifting column and/or lifting system.

The modular power system enables removing, switching and/or adding energy storage systems to an individual lifting column. This provides additional flexibility and increases time periods wherein the lifting column is available to a user.

Preferably, the lifting column's energy status is monitored by an energy storage management system and/or by a central/centralised energy storage management system when the lifting column signs on to a network, group and/or joins a lifting system. Optionally, the centralised/central energy storage management system can be incorporated in a central controller and/or in a network configuration, including an external network of a maintenance department or service company. This enables groups wise monitoring and control of energy status. In addition, or as alternative thereto, this enables monitoring, checking and control of energy status of an individual lifting column when in use and/or when an individual lifting column signs on to a network, group and/or joins a lifting system.

In a presently preferred embodiment the method comprises the step of providing an indication to a user or external network/system of the actual energy storage system status. This may relate to the energy storage system status of an individual lifting column and/or energy storage system status of a group of selected lifting columns. The user or external system may take action depending on the indication. For example, if the indication is provided that one of the mobile lifting columns is low on energy, the user or external system may take action to switch one or more of the energy storage systems of this specific lifting column. This indication can be provided with a warning signal including a visual or audio signal. Alternatively or in addition thereto the indication may involve a message to a mobile phone or computer.

In a presently preferred embodiment the method involves the step of performing an energy storage system planning for a number of lifting columns. This energy storage system planning involves timely charging empty energy storage systems. Preferably this also involves lifecycle management of individual energy storage systems such that the energy storage systems are timely removed.

In a presently preferred embodiment the energy storage system planning also involves selecting an appropriate lifting column with sufficient energy as indicated by the energy storage system status for performing the desired lifting operations with a selected number of lifting columns acting as a single group.

In a presently preferred embodiment the planning may also involve making suggestions to a user during the selection process for selecting specific lifting columns with sufficient energy as indicated by the energy storage system status. This provides additional flexibility in a workshop with a number of lifting columns wherein lifting columns need to be selected for a specific group to perform a lifting operation.

It is noted that features mentioned in relation to the lifting column can be applied to the lifting system and/or method according to the invention and vice versa.

BRIEF DESCRIPTION OF THE DRAWINGS

Further advantages, features and details will be elucidated on the basis of preferred embodiments thereof wherein reference is made to the accompanying drawings, in which.

DETAILED DESCRIPTION OF THE INVENTION

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

The system of the present invention is suitable for use with lifting systems comprising any number of lifting columns, including systems having one, two, four or another number of columns. The columns may achieve lifting and lowering capability by any means known to those of skill in the art, including hydraulically, electrically, mechanically, and electromechanically. Lifting systems may be stationary and/or permanently affixed or attached to a certain location or may be mobile, capable of being transported via wheels or any other suitable means known to those in the art. With reference to the figures, like element numbers refer to the same element between drawings.

Figure 1:
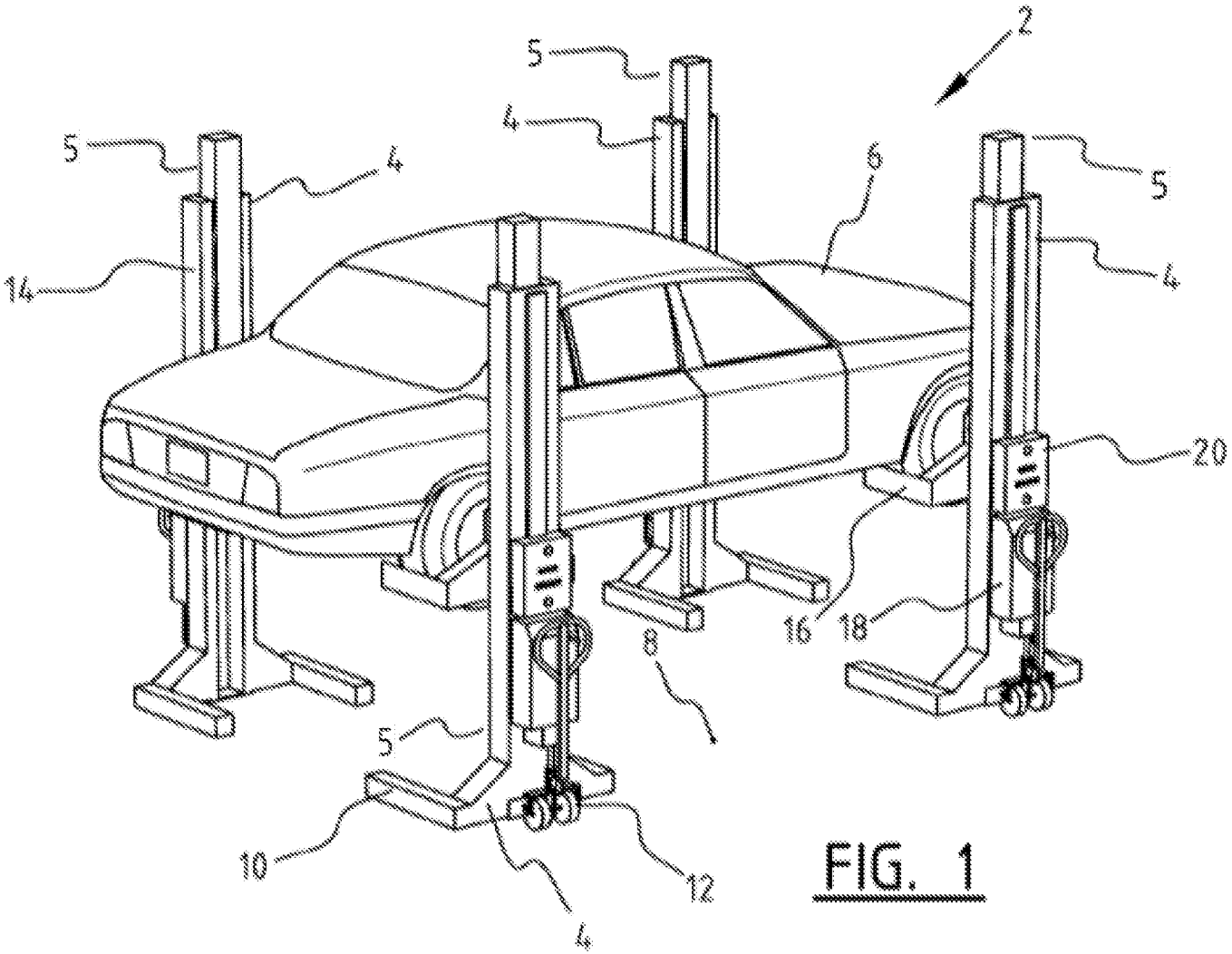
FIG. 1 shows a schematic overview of a vehicle lifted by lifting columns according to the invention.

System 2 for efficient lifting and lowering a load (FIG. 1) comprises four mobile lifting columns 4 in the illustrated embodiment. Lifting columns 4 lift a passenger car 6 from the ground 8. Lifting columns 4 are connected to each other and/or a control system by wireless communication means or alternatively by cables. Lifting columns 4 comprise a foot 10 which can travel on running wheels 12 over ground surface 8 of for instance a floor of a garage or workshop. In the forks of foot 10 there is provided an additional running wheel (not shown). Lifting column 4 furthermore comprises a mast 14. A carrier 16 is moveable upward and downward along mast 14. Carrier 16 is driven by a motor 18 that is provided in a housing of lifting column 4. Motor 18 is supplied with power from an energy storage system, more specific a battery, that is provided on lifting column 4 in the same housing as motor 18, or alternatively on foot 10 (not shown). Lift control with control panel 20 is provided to allow the user of system 2 to control the system, for example by enabling user input through panel 20, such as setting the speed for the carrier 16. Lifting system 2 includes at least two lifting columns 4. Each of the lifting columns has at least one ascent mode and one descent mode, and is under the influence of a control 20. Control 20 can be designed for each lifting column 4 individually, or for the lifting columns 4 together. Each lifting column 4 includes a frame 5.

Figure 3:
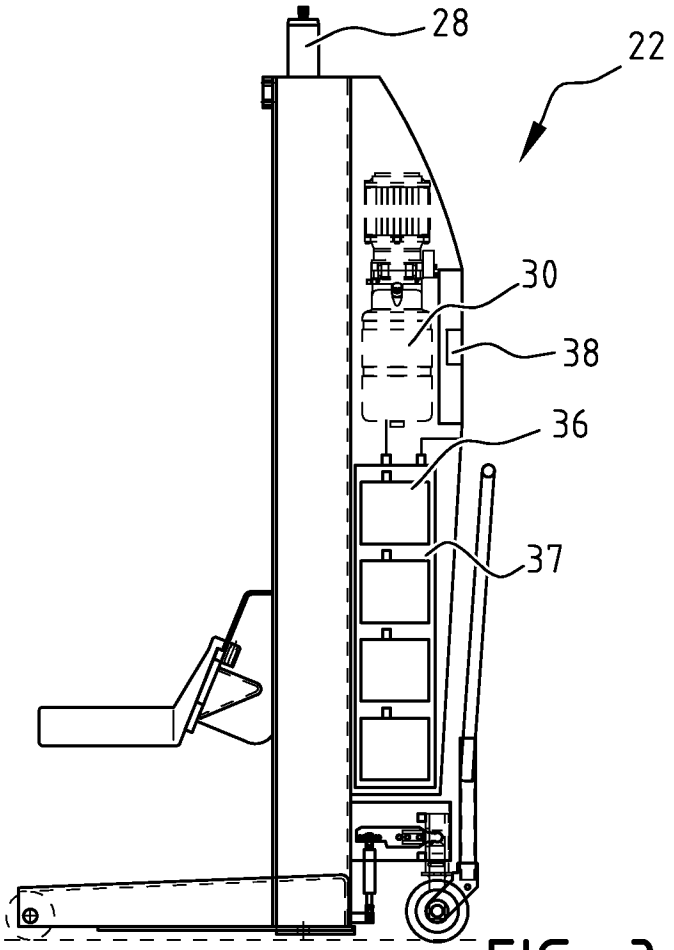
FIG. 3 shows the lifting column of FIG. 2 with another number of batteries.
Figure 2:
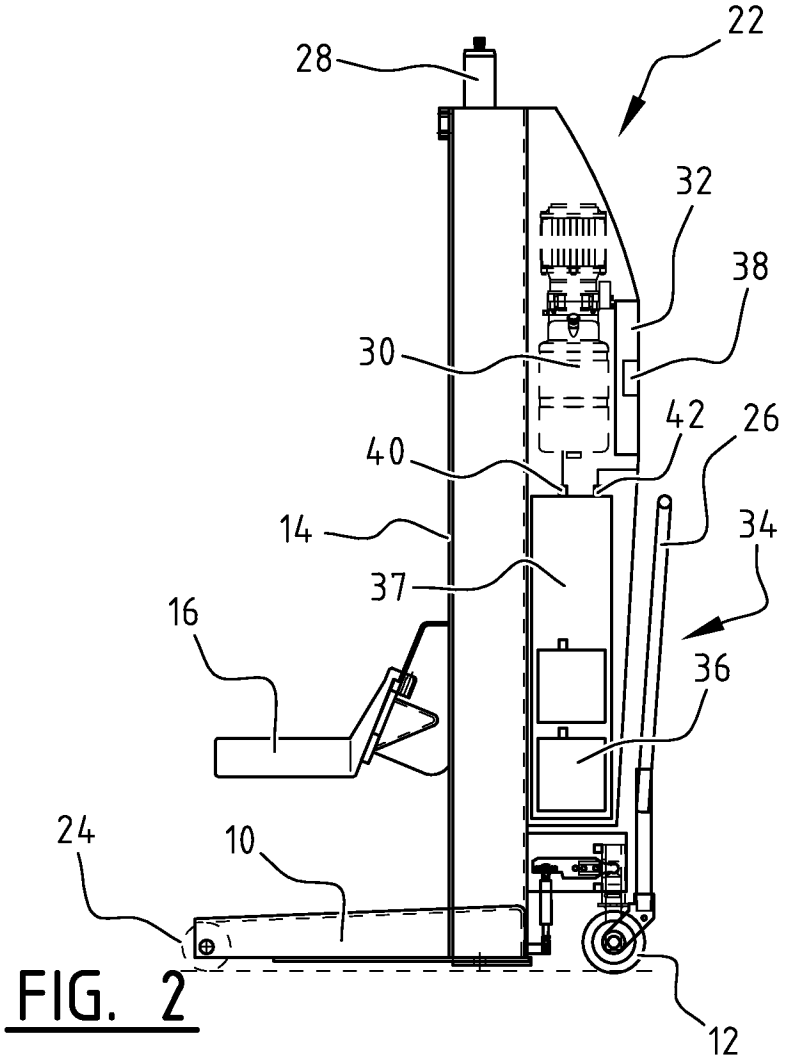
FIG. 2 shows one of the lifting columns of FIG. 1.

Lifting column 22 (FIGS. 2-3) comprises wheel 12 and additional running wheel 24 in foot 10. Mobile column 22 can be relocated using handle 26. Carrier 16 is moved along mast 14 using hydraulic cylinder 28. Hydraulic unit 30 comprises motor 18, a hydraulic pump, valves and a hydraulic tank. Column 22 is provided with touch screen 32 to enable user input. Modular power system 34 comprises a number a energy storage systems/batteries 36 that can be adjusted to user requirements. For example, column 22 may comprise two batteries (FIG. 2) or four batteries (FIG. 3). It will be understood that another number of batteries would also be possible. In the illustrated embodiment batteries 36 are placed in modular rack 37 enabling removing, changing and/or adding batteries. Energy storage system/battery management system 38 monitors battery status of modular power system 34 in its entirety and/or of individual batteries 36. Connector 40 enables charging batteries 36 by regeneration of energy in the descent mode of lifting column 2 operating hydraulic unit 30 as generator. External connector 42 enables charging batteries 38 from an external source.

Figures 4A, 4B:
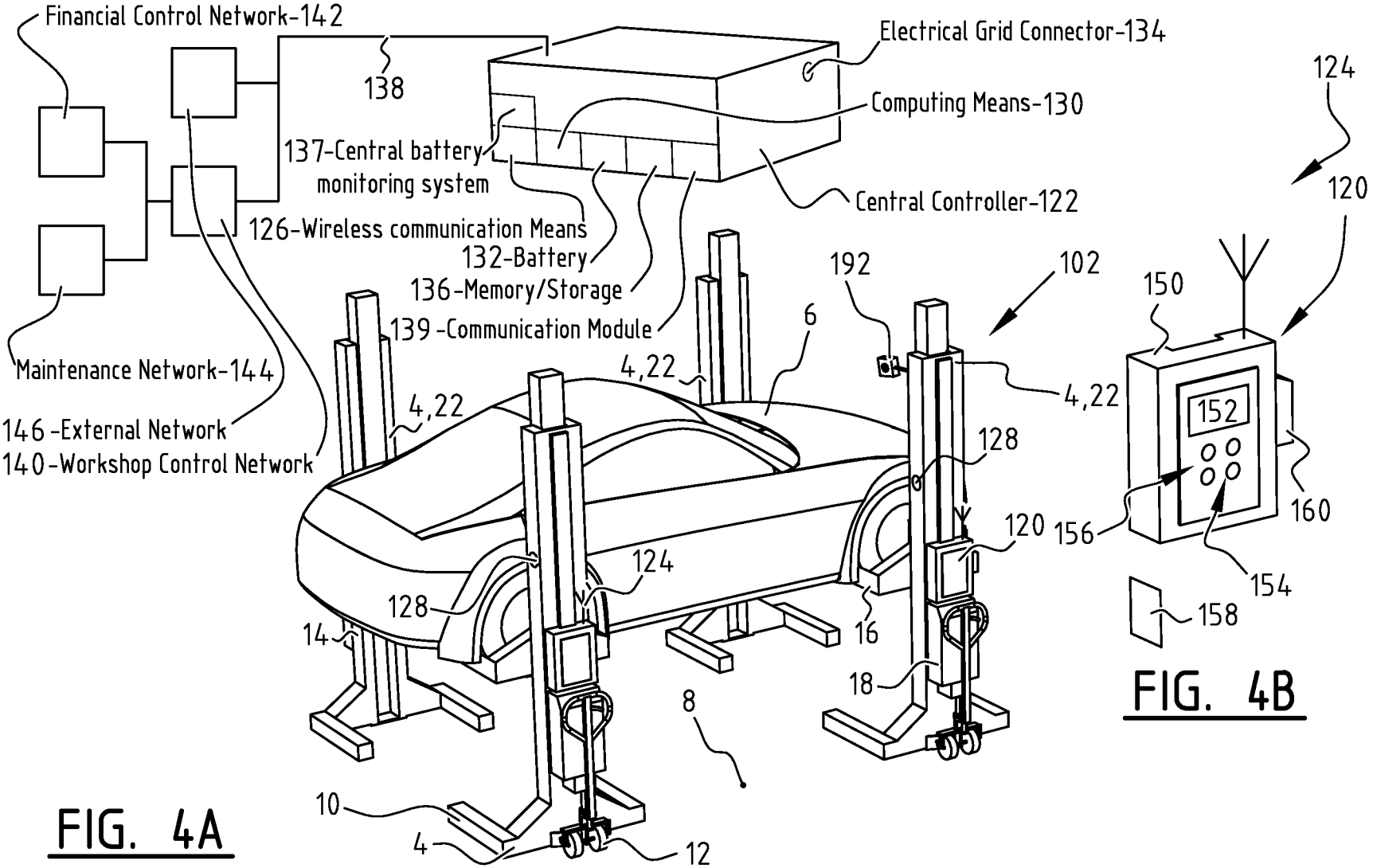
FIGS. 4A-B shows a schematic overview of a vehicle lifted by lifting columns with a central group controller.

Lifting system 102 (FIG. 4A,B) comprises four mobile lifting columns 4,22 in the illustrated embodiment. Lifting columns 4,22 lift passenger car 6 from ground 8. Display unit 120 may provide the user with information about the lifting system.

Lifting columns 4,22 are connected to central controller 122 by wireless communication means 124 on individual lifting column 4,22 and wireless communication means 126 on central controller 122. Wireless communication means 124, 126 involve one ore more transmitters and/or receivers.

The illustrated lifting system 2 includes at least two lifting columns 4,22. Each of the lifting columns has at least one ascent mode and one descent mode, and is under the influence of central controller 122. In the illustrated embodiment controller 122 is positioned centrally above lifting columns 4,22 assuring a good communication path between the individual lifting columns 4,22 and the central controller 122.

Central controller 122 determines the desired control actions. This may involve receiving a measurement signal representing the actual height of a carrier of an individual lifting column that is measured with height sensor 128 attached to an individual lifting column 4,22. Sensor 128 is capable of measuring position and/or speed of carrier 16. In the illustrated embodiment sensor 128 is a potentiometer and/or an inclinometer.

Central controller 122 detects height differences between lifting columns, calculates the required control actions with computing means 130, such as a processor, for individual lifting columns, and communicates the control actions to the relevant individual lifting columns. In the illustrated embodiment battery 132 provides power to central controller 122. Alternatively, or in addition, power is provided through connection 134 to controller 122 from the electrical grid. Data can be stored in memory/storage 136.

Central energy storage system/battery monitoring system 137 monitors battery status of individual lifting columns 4,22 and/or the group of selected lifting columns together. Central system 137 may operate directly in communication with power systems 34 and/or battery monitoring systems 38 of individual lifting columns 4,22.

Central controller 122 is provided with a wired and/or wireless connection 138 to enable connection between communication module 139 of central controller 122 to internal and/or external networks, involving internal company networks for workshop control 140, financial control 142 and maintenance 144, for example, and external networks 146 of suppliers and/or customers, for example, including battery handling departments or companies to enable timely removing, switching and/or adding one or more batteries 36 of power system 34 in response to battery monitoring system 38 of an individual lifting column 4,22.

Display unit 120 (FIG. 4B) comprises housing 150, a display 152, preferably a touch screen, optionally a number of buttons 154, an RFID antenna 156 enabling a user to identify himself with an ID-key 158 and/or pay for a number of lifts with a pre-paid card. In the illustrated embodiment unit 120 further comprises position determining means 160 and communication means 124, preferably providing wireless functionality to communicate in one or more environments such as LAN, WAN, VPN intranet, internet etc. that are schematically shown in the illustrated embodiments. Unit 120 is further provided with input/output ports, such as USB, SD card reader, smart phone communication possibilities etc. to improve the functionality. Display 152 may provide warning signals to the user. Display 152, preferably a TFT-LCD, is protected by a display lens cover of a resilient material, preferably scratch-resistant.

In the illustrated system 102 a user preferably performs a selection of lifting columns 4,22 that are incorporated in a group of selected lifting columns with a key or card 158 or other means. Central battery monitoring system 137 may suggest specific lifting columns 4,22 to select and/or prevent lifting columns 4,22 from being selected in case of insufficient battery power, for example. Preferably, the selected group of lifting columns 4,22 in system 102 is provided with user instructions on one of the lifting columns 4, using display 152, for example.

Transmitter/receivers 124, 126 provide the instructions to central system controller 122. On a central level, controller 122 determines the individual control actions to be taken for all lifting columns 4,22 in system 102. Transmitter/receivers 124, 126 provide the control actions from the central controller to the individual lifting column 4,22. Information about the actual position of carrier 16 and/or other relevant data is measured and the measurement data is provided to central controller 122 that determines if and what control actions are required. No direct communication between individual lifting columns 4,22 is required. This significantly contributes to the robustness of lifting system 102.

Figure 5:
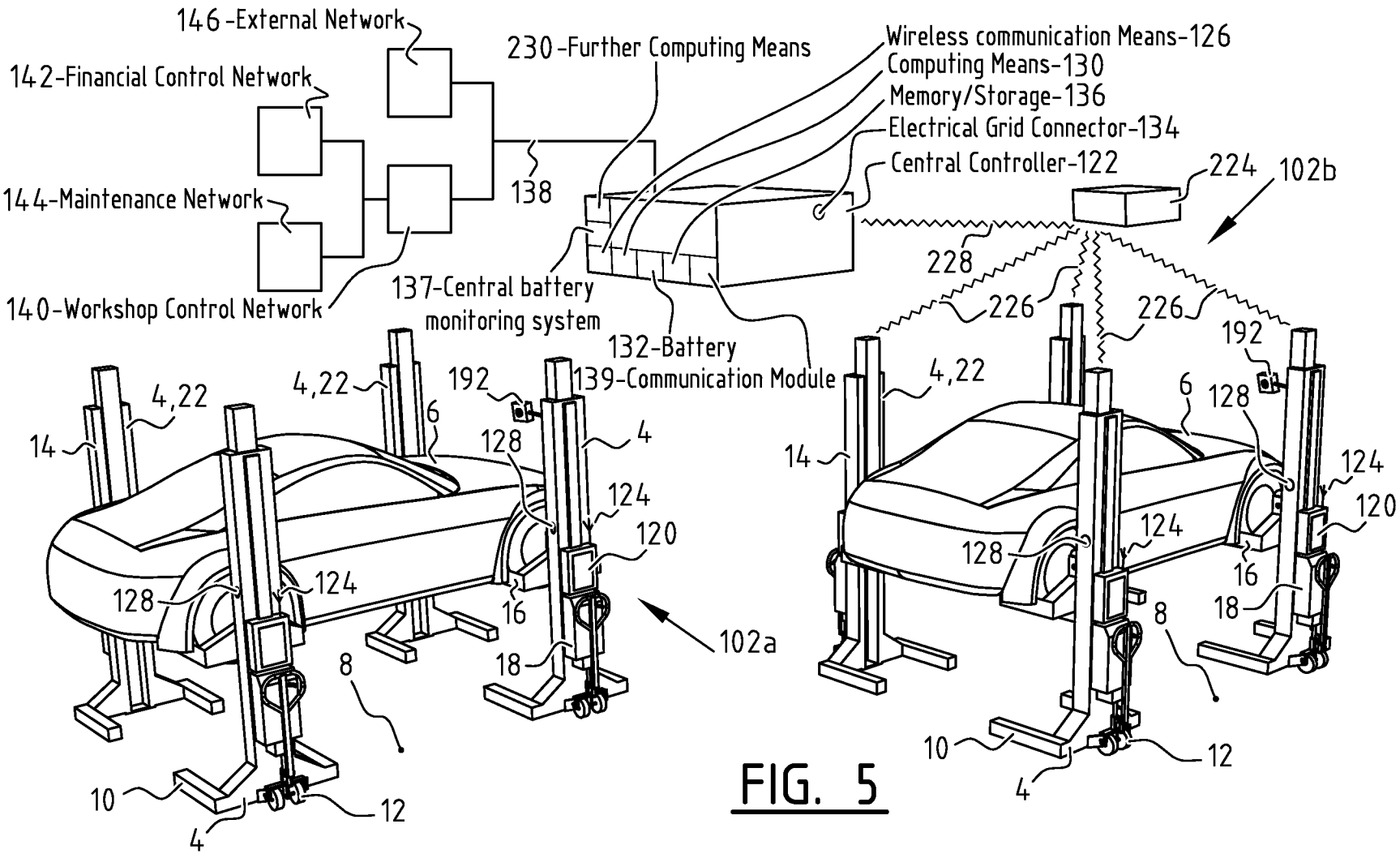
FIG. 5 shows an alternative system comprising a central group controller.

In an advantageous embodiment according to the invention, central controller 122 (FIG. 5) can be used to control a first group 102*a* of lifting columns 4 and a second group 102*b* of lifting columns 4. Operation and control of a single group 102*a*, 102*b* is substantially similar to the operation and control of a single system 102 with lifting columns 4,22. Optionally, first computing means 130 is provided with second or further computing means 230. Furthermore, central controller 122 can be provided with additional multiple components to improve overall control operation and robustness.

In a further embodiment central controller 222 (FIG. 5) is provided with a number of communicators/distributors 224, such as an RF-host, that send and/or receive signals 226 between lifting columns 4 and communicator 224, and signals 228 between communicator/distributor 224 and central controller 222. Communicators/distributors 224 provide additional robustness to the overall operation of the groups 102*a*, 102*b* of lifting columns 4,22.

In an alternative embodiment central controller 122 is placed in a portable housing.

Optionally, camera system 192 is used as vehicle identification system and/or monitoring means to monitor the lifting operation or parts thereof.

In a further alternative embodiment, lifting system 102, for example involving card or key 158, can be used to select lifting columns 4,22 and/or in a pay-per-lift or release procedure.

When selecting individual lifting columns for a lifting system, battery management system 137,38 may suggest which lifting columns to chose. After the selection is made, the mobile lifting columns are positioned relative to vehicle 6 to be lifted. The lifting operation can be performed knowing that sufficient energy is available. Battery management system 137, 38 provides indications involving audio and/or visual signals and/or messages to a user or external system in case a battery status is below a limit.

The present invention can be applied to mobile (wireless) lifting columns illustrated in the figures. Alternatively the invention can be also be applied to other types of lifting columns and lifting systems.

The present invention is by no means limited to the above described preferred embodiments thereof. The rights sought are defined by the following claims within the scope of which many modifications can be envisaged.

The invention claimed is:

1. A lifting system for lifting a vehicle, comprising:

a plurality of individual lifting columns, wherein each of the individual lifting columns comprises:

a frame with a carrier configured for carrying the vehicle;

a drive for driving the carrier in at least one of an ascent or descent of the carrier; and a modular power system configured for providing power to the drive and adapted to comprise a variable number of energy storage systems, wherein the variable number of energy storage systems can be selected based on the lifting requirements of the lifting column; and a central controller comprising a central energy storage management system capable of monitoring energy storage system status of the energy storage systems of each of the individual lifting columns.

2. The lifting system according to claim 1, wherein the modular power system of each of the individual lifting columns comprises a modular rack configured for removing, switching and adding the variable number of energy storage systems.

3. The lifting system according to claim 1, wherein each of the individual lifting columns further comprises an energy regeneration system.

4. The lifting system according to claim 3, wherein the energy regeneration system of each of the individual lifting columns comprises an ascent mode and a descent mode, wherein in the ascent mode, a motor drives a pump, and in the descent mode, the pump drives the motor as a generator.

5. The lifting system according to claim 1, wherein the central controller comprises:

a transmitter/receiver for communication with the individual lifting columns; and a processor for determining required control actions for the individual lifting columns;

wherein at least one of the central controller or at least one of the individual lifting columns comprises user input means configured for providing the central controller with input.

6. The lifting system according to claim 1, wherein the central controller controls two or more independent groups of selected lifting columns.

7. The lifting system according to claim 1, further comprising a signal distributor for receiving and forwarding signals between the central controller and one or more of the individual lifting columns.

8. A method for, performing a lifting operation, comprising the steps of providing the lifting system according to claim 1, providing to each of the individual lifting columns the modular power system comprising at least one of the energy storage systems, and operating the lifting system to perform the lifting operation, wherein power is supplied to each of the individual lifting columns during the lifting operation from the modular power system provided to that individual lifting column.

9. The method according to claim 8, further comprising the step of providing an indication to a user or external system of energy storage system status of each of the individual lifting columns.

10. The method according to claim 8, further comprising the step of performing an energy storage system planning for each of the individual lifting columns.

11. The method according to claim 10, wherein the energy storage system planning involves lifecycle management of the energy storage system of each of the individual lifting columns.

12. The method according to claim 10, wherein the energy storage system planning involves indicating energy storage system status for each of the individual lifting columns in the selection process for a new group of lifting columns.

* * * * *